United States Patent [19]

Hannes et al.

[11] 4,355,787

[45] Oct. 26, 1982

[54] METHOD OF CONTROLLING THE NOZZLE DAMPER OF A METALLURGICAL VESSEL

[75] Inventors: Heinz D. Hannes, Düren-Echtz; Josef Lothmann, Langerwehe; Ludwig Walther, Düren-Niederau, all of Fed. Rep. of Germany

[73] Assignee: Zimmermann & Jansen GmbH, Düren, Fed. Rep. of Germany

[21] Appl. No.: 166,695

[22] Filed: Jul. 2, 1980

[30] Foreign Application Priority Data

Jul. 3, 1979 [DE] Fed. Rep. of Germany ..... 2926863

[51] Int. Cl.[3] ..... C21D 11/00

[52] U.S. Cl. ..... 266/92; 266/44; 266/45; 266/78

[58] Field of Search ..... 266/92, 44, 45, 78, 266/272, 223; 75/60

[56] References Cited

U.S. PATENT DOCUMENTS 3,084,925 4/1963 Stauffer ..... 266/272

4,230,308 10/1980 Gueguen ..... 266/92

FOREIGN PATENT DOCUMENTS 1483660 of 1972 Fed. Rep. of Germany .

2817115 of 1978 Fed. Rep. of Germany .

OTHER PUBLICATIONS

Stahl u. Eisen, 1977, vol. 7, pp. 318–324.

*Primary Examiner*—P. D. Rosenberg

*Attorney, Agent, or Firm*—Cushman, Darby & Cushman

[57] ABSTRACT

Disclosed is a method of controlling the nozzle damper (slide valve) of a vessel for the metallurgical casting, in response of the variation of the molten metal level of the volume of molten metal tapped from said vessel the nozzle opening is stepwise controlled in response to, the value of the vertical level of the molten metal above said nozzle damper at the respective tapping time or after the respective tapping period with the molten metal volume calculated from the time integral of the respective previous actual damper opening areas.

13 Claims, 6 Drawing Figures

METHOD OF CONTROLLING THE NOZZLE DAMPER OF A METALLURGICAL VESSEL

The present invention relates to a method of controlling the nozzle damper (slide valve) of a vessel for metallurgical casting, in response of variations of the molten metal level of the volume of molten metal tapped from the vessel.

In the control of nozzle dampers (slide valves), especially of casting ladle dampers for continuous casting, it is important that the tapping or pouring volume remain as constant as possible, such that the rate of withdrawal of the cast strand remains constant. Further, it is important that the tapped stream is not upset by the controlling movements of the nozzle damper.

The conventional control methods and processes operate in accordance with the proportional control principle or on an analog basis, wherein the nozzle damper motions continuously follow the variations of the molten metal level in, for example, a mold or a tundish.

The drawback of analog control resides particularly in the fact that the proportional valves required on the hydraulic side are extremely susceptible to trouble and are of complicated construction. Besides, balance of the electric current supplied is quite difficult since the magnetic force of the generally utilized magnetic valves depends directly on the differential pressure, the viscosity of the fluids and the temperature thereof, respectively. In view of the fact that these parameters vary constantly in operation, the original balance will be lost and instead new values. In operation, this results in overshooting or undershooting of the set values will be taken on, whereby fluctuations are introduced into the active process (controlling) elements and even into the pouring flow.

Still further, it is conventionally known that in the so-called "floating" proportional control or adjustment the durability of the refractory material within the nozzle shut-off device or damper is extremely limited.

An object of the present invention is the provision of a method of the above-indicated kind, by which the above discussed drawbacks may be avoided, and wherein particularly the volume of molten metal cast or tapped per unit of time may be adapted in optimum manner to a predetermined constant rate of continuous casting with a minimum of actual value measurements.

According to the present invention, this object is solved by a stepwise (incremental) control to a predetermined set value of the nozzle opening, wherein the control values of said nozzle damper are determined and set by using the value of the vertical level of the molten metal above said nozzle damper at the respective tapping time or after the respective tapping period with the molten metal volume calculated from the time integral of the respective previous actual damper opening areas.

The solution according to the present invention provides for an uncomplicated control of nozzle dampers, which control operates on the basis of control or adjustment cycles and steady state intervals (digital basis), wherein complicated proportional valves tending to fail may be omitted, and which is characterized especially by an exact matching of the volume of molten metal cast or tapped per unit of time to a given constant rate of continuous casting; this being due to the fact that the data (units) of the preceding step of correction of the nozzle damper are also taken into account in each successive control cycle. Still further, by taking into account the respective ferrostatic head existing in the vessel for metallurgical castings, e.g. in the ladle, and the volume of molten metal cast during the preceding period, in the method according to the invention the variation of the viscosity, the temperature and the differential pressure are fully taken into account.

The method according to the present invention is particularly suitable for so-called sequential casting. Normally, this mode of operation means that the rate of pouring or tapping, with the opening (cross-sectional) area being constant, is switched from a minimum (last ladle used for casting) to a maximum (new ladle to be tapped). The method according to the invention permits an immediate correction or matching to the varied conditions.

Below, the method according to the present invention is described in detail by referring to a control circuit schematically shown in the enclosed drawings, and the components of such circuit. In the drawings.

Figure 1:
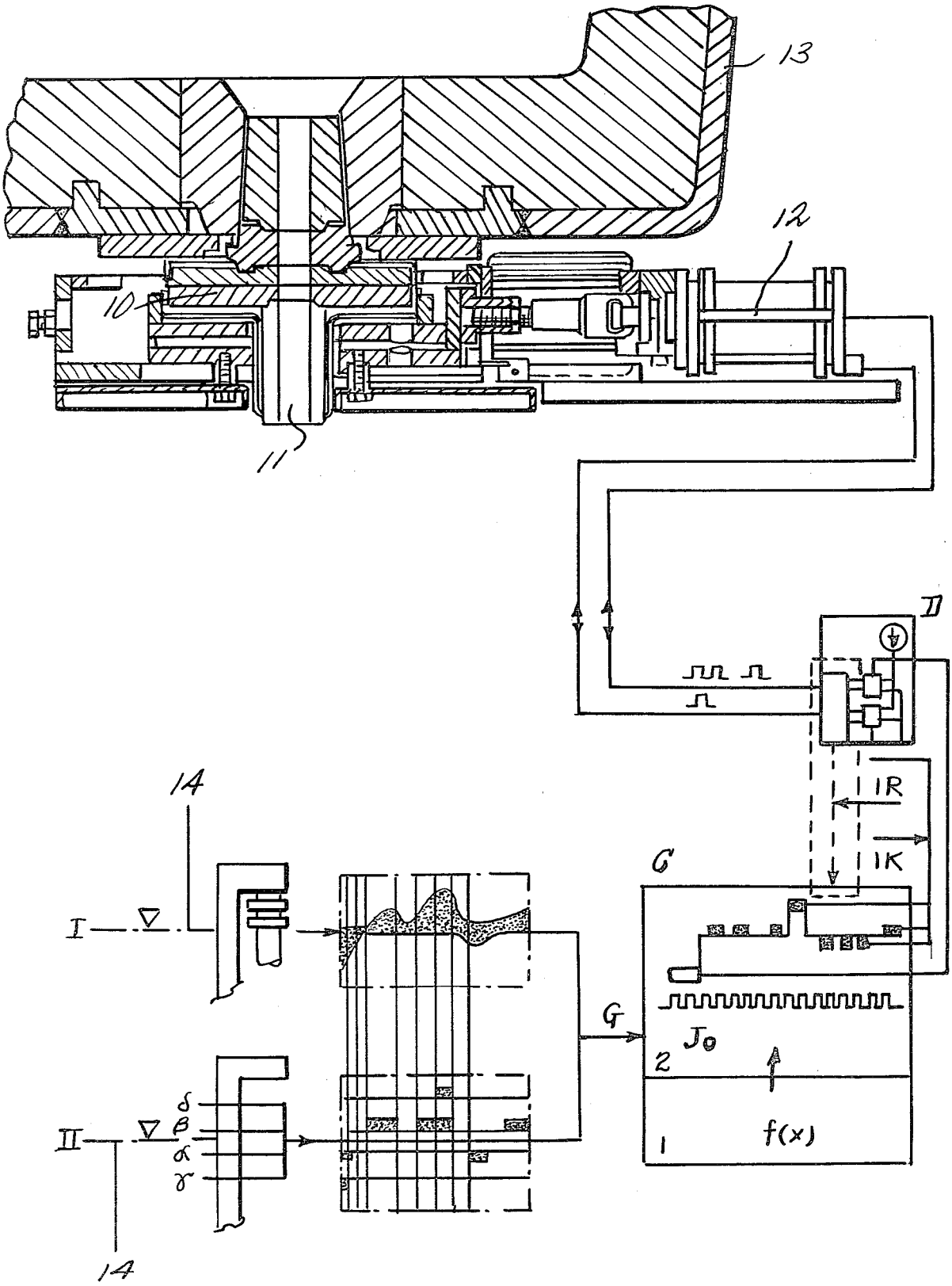
FIG. 1 shows a compatible timing control for a ladle damper, operating with the use of the control circuit according to the invention.

FIG. 1 illustrates the fundamental construction of the complete control system for carrying out the present method for controlling (adjusting) a ladle damper 10. The damper plate and the nozzle sleeve including a steel frame are adapted to be shifted to and fro by means of a hydraulic piston-cylinder unit 12. Accordingly, said unit 12 is operative to move the damper plate including the nozzle sleeve to control thereby the size of the cross-sectional area of the nozzle opening. Numeral 13 indicates the lower portion of a casting ladle.

The molten metal is poured from the ladle 13 into a casting mold or into a tundish (not shown in FIG. 1). For the control of the nozzle opening area, the variation of the molten metal level 14 of the cast or tapped volume of molten metal (melt) is taken into account, i.e. included into the control. The respective actual value may exist in the form of an analog signal "I" or a digital signal "II". The control unit C processing the actual values is compatible for both forms of signals. It is only necessary to use different terminals for input G. When using a signal generator for "I", an analog-digital converter (not illustrated) is interposed, which provides for the threshold values, corresponding variable current, voltage, resistance, induction or capacitance values so as to define the digital sweep values. Accordingly, the following description may be based upon signal form "II" as the signal waveform "I" shows the same character as signal waveform "II" on the output side of the analog-digital converter.

A critical factor for stabilized control action or response is the respective position feedback indication of a power cylinder 12 or of damper plate 11, respectively, because—as will be discussed in greater detail below—the instantaneous nozzle opening area enters into the actual value control. Two alternatives offer themselves for the position feedback, which must be differentiated with respect to their accuracy:

(1) The stroke period versus the nozzle diameter which results from the pump capacity and the rated width of the control valve, is measured by the impressed frequency Io such that a specific pulse quantity I is obtained for a given stroke H or a given cross-sectional area $A_1$, respectively.

(2) The hydraulic system D includes a reference circuit 3 which will be explained in more detail below in connection with FIG. 4. Instead of the reference circuit 3, the devices according to FIGS. 5 and 6 may be provided for position feedback indication.

The second alternative represents the more accurate solution, since the pulse quantity is related directly to the stroke length or the nozzle opening area, respectively.

The following applies: Each stroke position H or each nozzle opening area $A_1$ is represented by a pulse quantity I in every instant; likewise a cross-sectional area $zA_1$ is known in advance by an impulse quantity zI.

Figure 2:
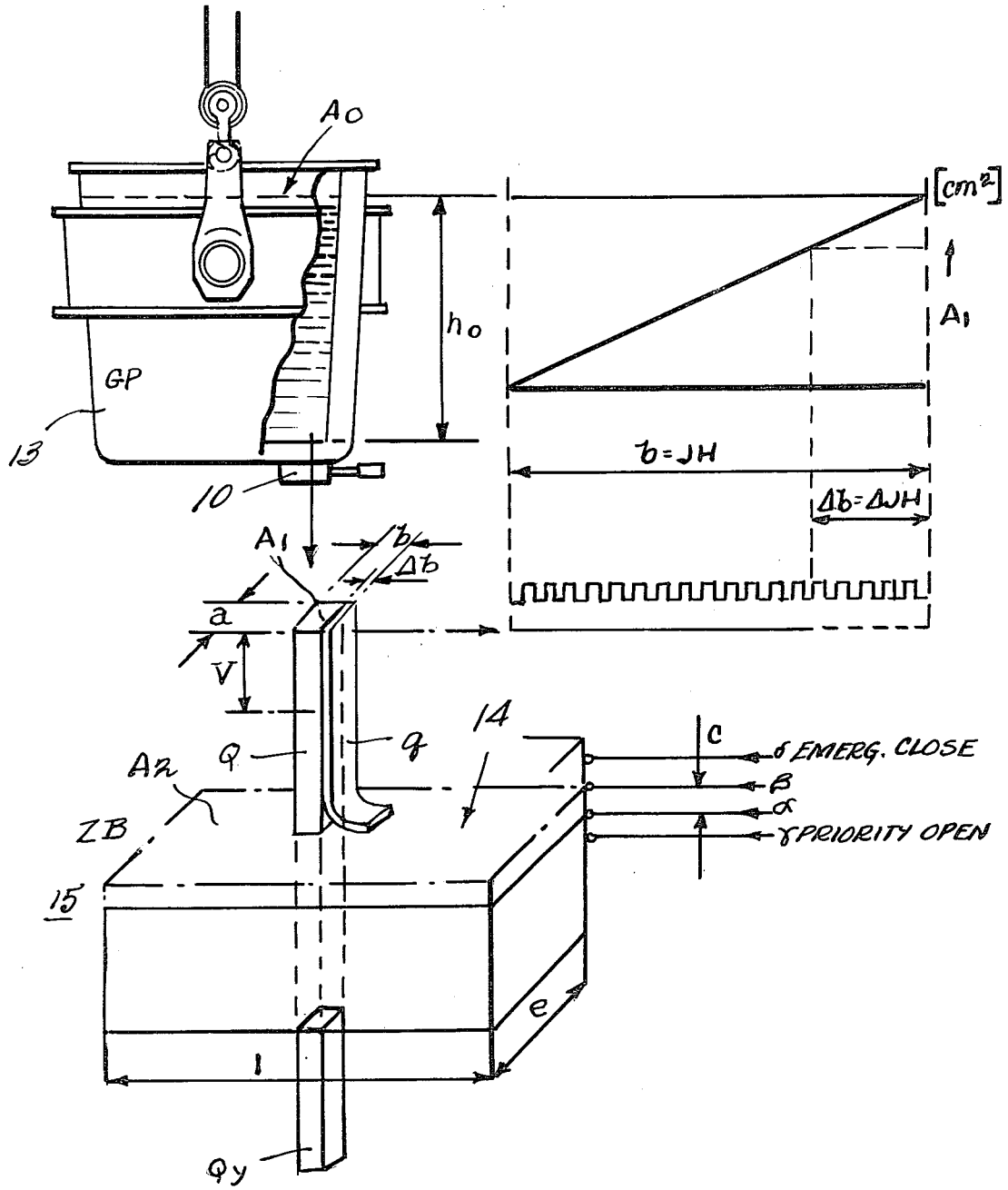
FIG. 2 is a schematical illustration of the physical parameters.

The physical parameters or conditions which are utilized in the method according to the invention are now explained in detail (see FIG. 2). The graph of FIG. 2 shows the process during the casting operation from the ladle 13 into a tundish 15 and, further, into a continuous casting mold not illustrated in detail. In the example shown in FIG. 2, the melt level 14 of the tundish 15 is controlled by means of the ladle damper (slide valve) 10. In the same manner, this principle may be used for controlling the melt level of a continuous casting mold by means of a tundish damper or by means of the ladle damper 10 per se.

In order to illustrate more clearly the conditions, the nozzle opening area $A_1$ of the melt flow, is not shown with a circular configuration, but instead with a square or rectangular configuration. Accordingly, the nozzle opening area may be calculated on the basis of the following equation:

$$A_1=(D^2\cdot\pi)/4=a\cdot b \tag{1}$$

FIG. 2 shows the casting stream column Q which includes an excess capacity q, assuming that the output capacity or volume fed to the continuous casting mold is equal to $$Qy = Q - q\left[\frac{m^3}{s}\right] \tag{2}$$

The excess capacity q of the liquid stream is defined by:

$$a\cdot\Delta b\cdot v\left[\frac{m^3}{s}\right] \tag{3}$$

The time interval (period) ΔT which the liquid level requires to rise across the detection distance $\alpha\beta=c$, is defined by equation (2). $\alpha$, $\beta$ are melt level limit detection positions, with the detection distance c defining a so-called set value band within which the melt level should fall. The measured values already include any values of flow losses because the existing actual excess capacity g is determined via ΔT on the basis of the exactly known magnitudes $$A_1=a\cdot b\ [m^2] \tag{4}$$

and $$A_2=e\cdot 1\ [m^2] \tag{5}$$

Accordingly, the following relation results for the time interval ΔT:

$$\Delta T=\frac{A_2\cdot c}{\Delta A_1\cdot v}\left[\frac{m^2\cdot m\cdot s}{m^2\cdot m}\right] \tag{6}$$

The instantaneous nozzle opening area $A_1$ is known from the feedback information gained during the last interval ΔT (from the piston position feedback).

The rate of pouring v is a critical factor which, for example in a 300 tons ladle, has the ratio of 1:10 (full ladle relative to almost empty ladle). On the other hand, the opening area $A_1$, or even the excess area $\Delta A_1$ producing the excess capacity q, is directly related to this constantly varying rate of flow v. Therefore, this factor must be determined from the data and processed in the control unit C (see FIG. 3) for controlling the damper movement.

Below, control unit C of FIG. 1 is explained in greater detail by referring to FIG. 3.

A frequency generator 1.1 provides an impressed constant frequency of e.g. 50 Hz. This frequency is reduced to a suitable, smaller pulse rate by a subsequently connected unit 1.2.

In the counter unit (function unit forward counter) 2.1, the time intervals as defined by the limit detection positions $\alpha$ and $\beta$, are registered as pulse quantities. Thus, the number of the registered pulses is equivalent to the (period of) time which lapses during the rise or fall of the melt level across the actual value band defined by the two limit detection positions $\alpha$ and $\beta$. The registered pulse quantity is transmitted to an arithmetic unit 11.1. The arithmetic unit 11.1 functions in accordance with the following equation:

$$\Delta b_n=(A_2\cdot c)/(a\cdot\Delta T\cdot v_n)\cdot Z_n \tag{7}$$

In this way, the arithmetic unit 11.1 received the first operand ΔT being required.

Operands $A_2$ and c are permanently given as constant values or magnitudes. These constant operands are furnished by setting devices 11.12 and 11.13. Hereby, $A_2$ is the cross-sectional area of the tundish 15 or of the mold, respectively, when a tundish is not provided.

Operand a being an invariable side length of the nozzle opening area is likewise a predetermined, constant value (see FIG. 2) which is provided by a setting device 3.14.

The nozzle diameter to be used is defined by setting device 3.14.

Figure 4:
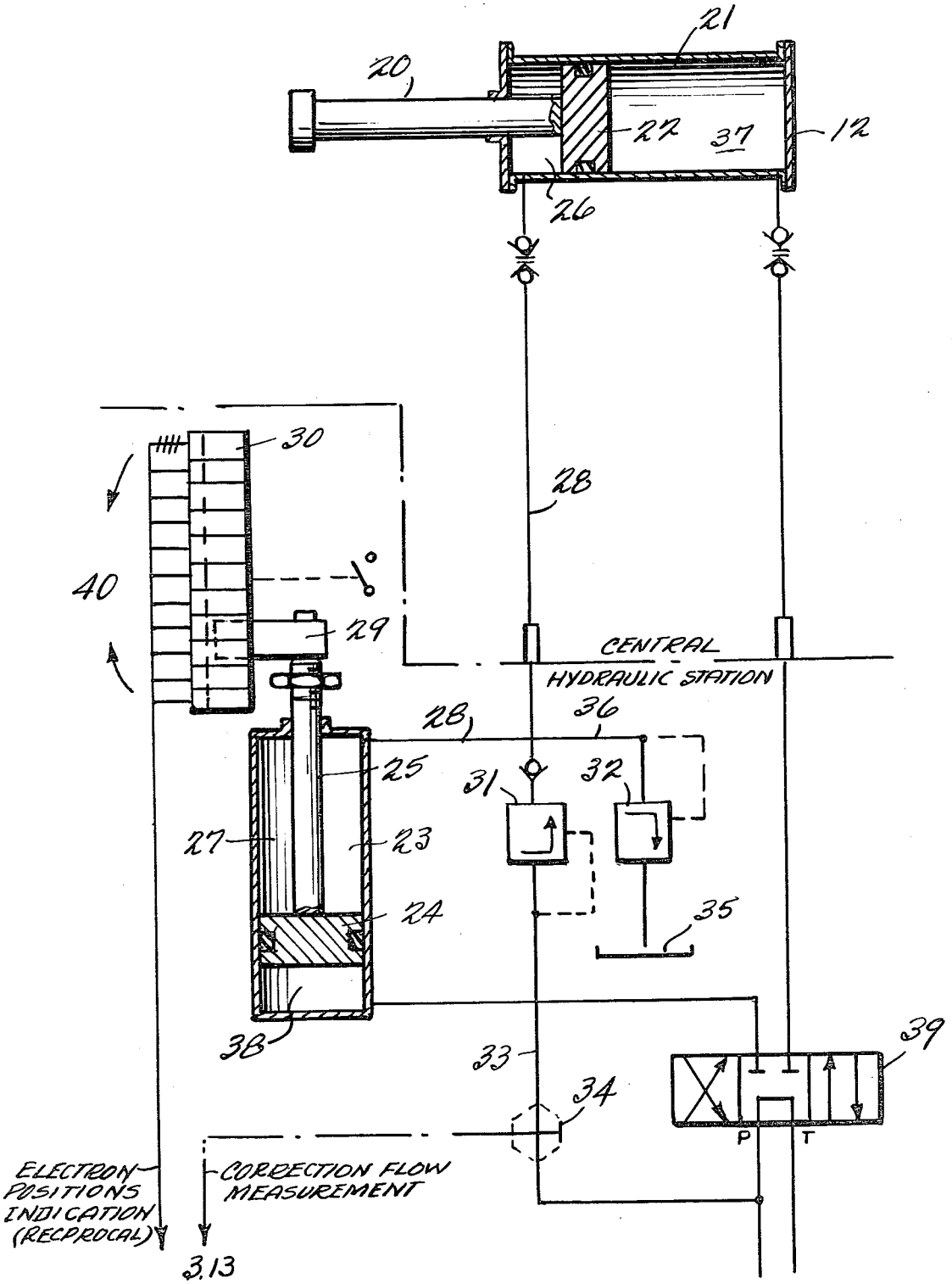
FIG. 4 shows a first embodiment of a device for the exact feedback indication of the nozzle damper position.
Figure 5:
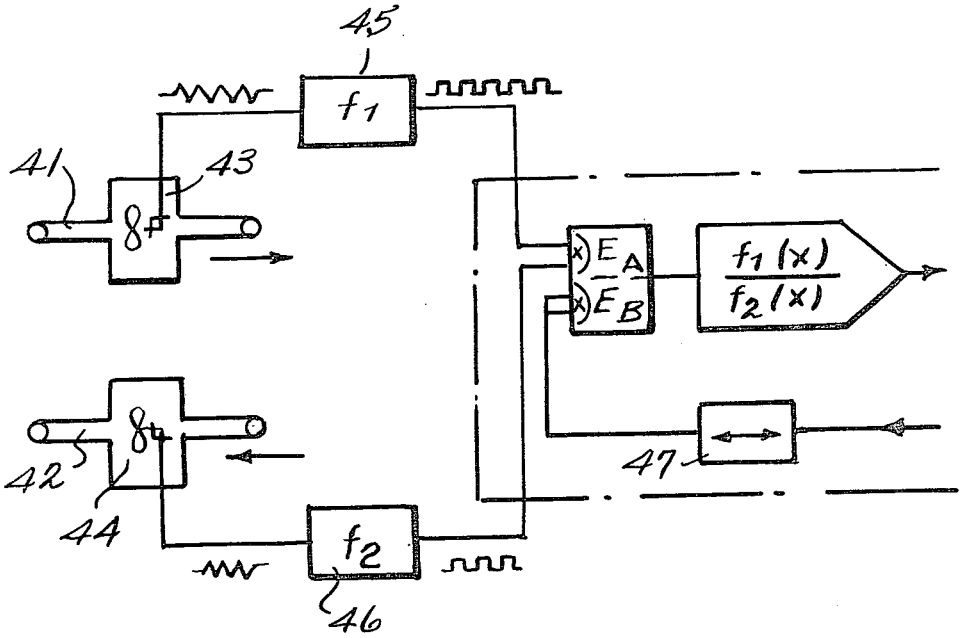
FIG. 5 shows a second embodiment of a device for the exact feedback indication of the nozzle damper position.
Figure 6:
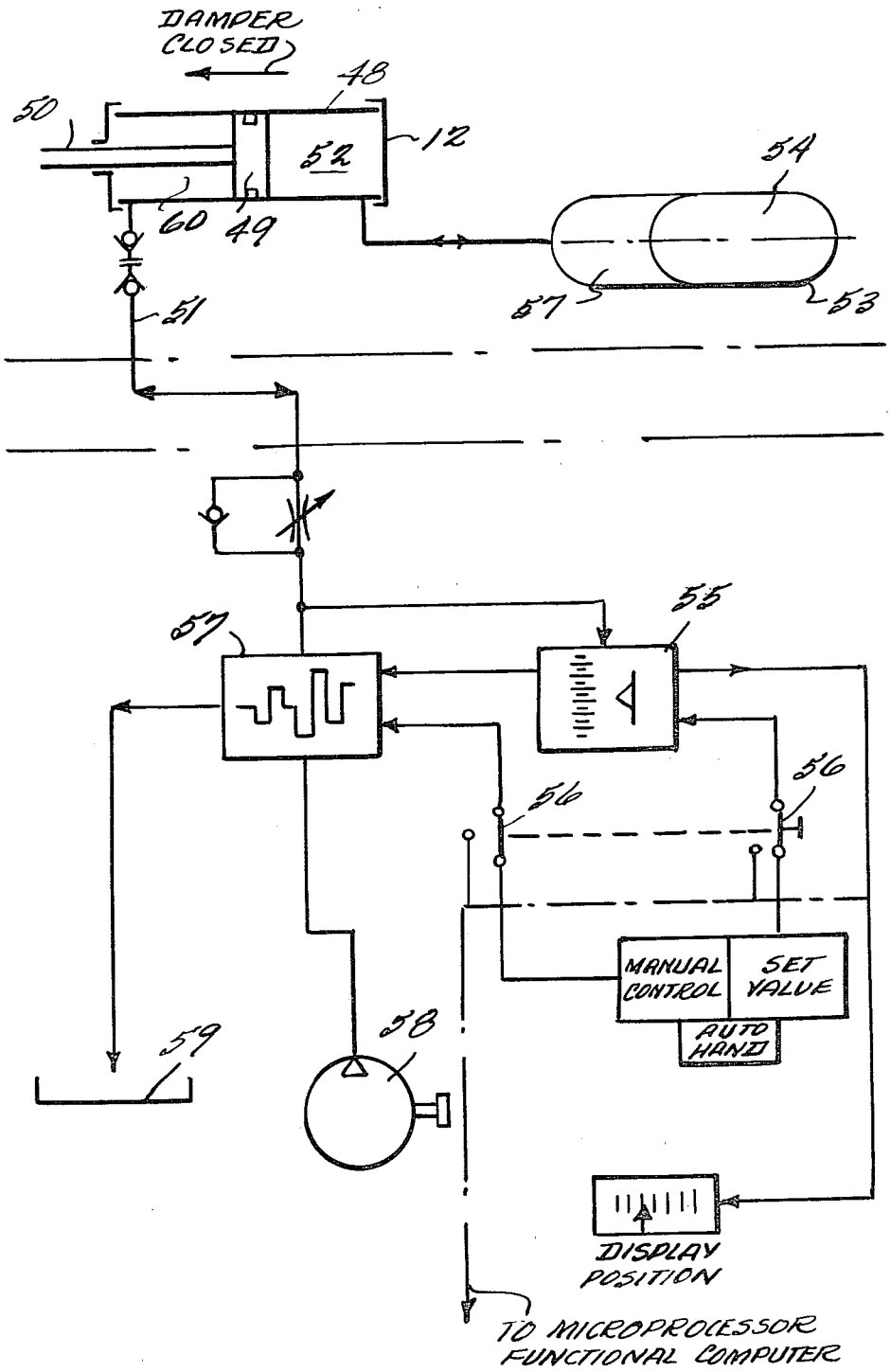
FIG. 6 shows a third embodiment of a device for the exact feedback indication of the nozzle damper position.

Now, it is necessary to determine the rate of flow or rate of outflow v at every point of time T, and to communicate this rate to the arithmetic unit 11.1 for the selection of the next correction step to be taken. The rate of outflow (rate of pouring) v is determined as follows:

Position 3.13 represents the feedback information IR of the nozzle damper 10 as furnished by the devices according to FIGS. 4 to 6 (see also FIG. 1 in which the feedback information IR is schematically shown). A kind of feedback loop is formed by the feedback signal IR.

The feedback pulses IR are held in forward-backward counter 3.1 in very instant. In the arithmetic section of this counter 3.1, the instantaneous nozzle opening area is determined in combination with the formerly performed diameter calculation 3.14, in accordance with the following equation:

$$d A_1/dt \tag{8}$$

The respective value is constantly entered into computer unit 5.1 which in accordance with the following equation $$Q_n = \int_{t_1}^{t_n} f(t) \cdot dt \cdot dA_1 \tag{9}$$

calculates and continuously counts up the melt volume Qn flowed out from the ladle 13 until the time of activation n.

Finally, an arithmetic unit 6.1 determines the actual ferrostatic level hn of the molten metal in the ladle 13 at the time of activation n, in accordance with the following equation:

$$hn = ho - Qn/Ao \tag{10}$$

The cross-sectional area Ao of the ladle 13 is set by means of a setting device 6.11. Likewise, the maximum ferrostatic head ho existing in the ladle 13 is set by a setting device 6.14.

The ferrostatic level or head hn is entered into arithmetic unit 4.1 which determines the then prevailing rate of outflow $v_n$ in accordance with the following equation:

$$v_n = \sqrt{\frac{2g \cdot hn}{1 + \lambda \cdot \frac{L}{D}}} \tag{11}$$

Equation (11) with λ and L/D takes into account the flow losses in the nozzle.

The value λ is preset by a setting device 4.11, while the length L of the ladle nozzle is preset by means of a setting device 4.12.

The nozzle diameter is taken as a factor from counter unit 3.1.

Finally, the rate of flow v prevailing at every time of activity n is communicated to the arithmetic unit 11.1.

In this way, equation (7) may come into effect, with the exception of factor Z still to be explained. In accordance with equation (7), arithmetic unit 11.1 determines a given pulse quantity Ik being required in the subsequent step of correction for a variation of the cross-sectional area or nozzle opening area $A_1$, and, thus for the damper plate position at the instant when the melt level of the cast volume of molten metal falls above or below the limit detection positions α or β.

The resulting excess or minus capacity q is eliminated in the subsequent correction step.

The pulse quantity Ik for the subsequent correction step is fed as a single control cycle to a hydraulic valve (item 1 in the hydraulic circuit I of FIG. 1). At the same time, the variation value is given in accordance with equation $$IK/IR = 1 \tag{12}$$

The ratio Ik/IR is 1, and this ratio is aimed for as the ideal case. In this ideal case, the nozzle damper is in the set value position.

Also of importance are the detection positions γ and δ.

The detection positions γ and δ represent lowermost and uppermost limits at which, when exceeded in positive or negative direction, the nozzle damper is moved at increased speed to a fully open position or a fully closed position. Accordingly, optimum control measures have to be taken when these detection positions are reached. By means of a counter device 2.2 (FIG. 3), upon reaching the detection positions γ or δ a given fixed pulse rate is directly applied, as control pulse cycle, to a hydraulic bypass valve (item 2 in the hydraulic circuit D of FIG. 1), whereby the damper plate 11 is immediately opened or closed completely.

This portion of the overall control system may also intervene with the above-discussed melt level control (α, β). However, it is not advantageous for refractory damper plates that a minimum of the opening cross-sectional area is predetermined by the arithmetic circuit. For example, it may be noted that the opening cross-sectional area or the nozzle opening area should not become smaller than 25% of the full area. When the control arrives at this limit, intervention may take place by means of the measures to be described next:

A threshold value contact 3.11 the position of which is determined by a setting device 3.12, is in direct communication with the up/down counter 3.1.

If, for example, the 25% limit is reached, contact 3.11 releases a fixed pulse rate from unit 2.2, whereby the nozzle damper 10 is immediately closed through the hydraulic bypass valve 2 (FIG. 1).

In such case, no other measured quantities than the limit detection positions α through δ are involved in the control.

The control unit described above may further operate with other measured quantities, for example:

(a) with measured quantities furnished by a weighing device 7.12 for the casting ladle 13. In this case, control unit C is switched by a change-over switch 6.12 in such a manner that the ferrostatic heads Ho and Hn provided by units 6.14 and 6.1 may be dispensed with. When the measured quantities of a weighing device 7.12 are used, these two units are bypassed. The ladle weight is utilized directly to determine the outflow or tapping rate v.

(b) With the rate of withdrawal of the continuously cast strand 8.13. In this case, control unit C is switched by a change-over switch 6.13 in such a manner that the poured volume Qyn is directly used to calculate the instantaneous ferrostatic head hn existing in the ladle. In such case, the poured volume Qyn is calculated on the basis of equation $$Qyn = \int_{t_1}^{tn} f(t) \cdot dt \cdot A_3 \tag{13}$$

wherein $A_3$ is the cross-sectional area of the withdrawn cast strand. $v_y$ indicates the rate of withdrawal of the cast strand 8.13.

Figure 3:
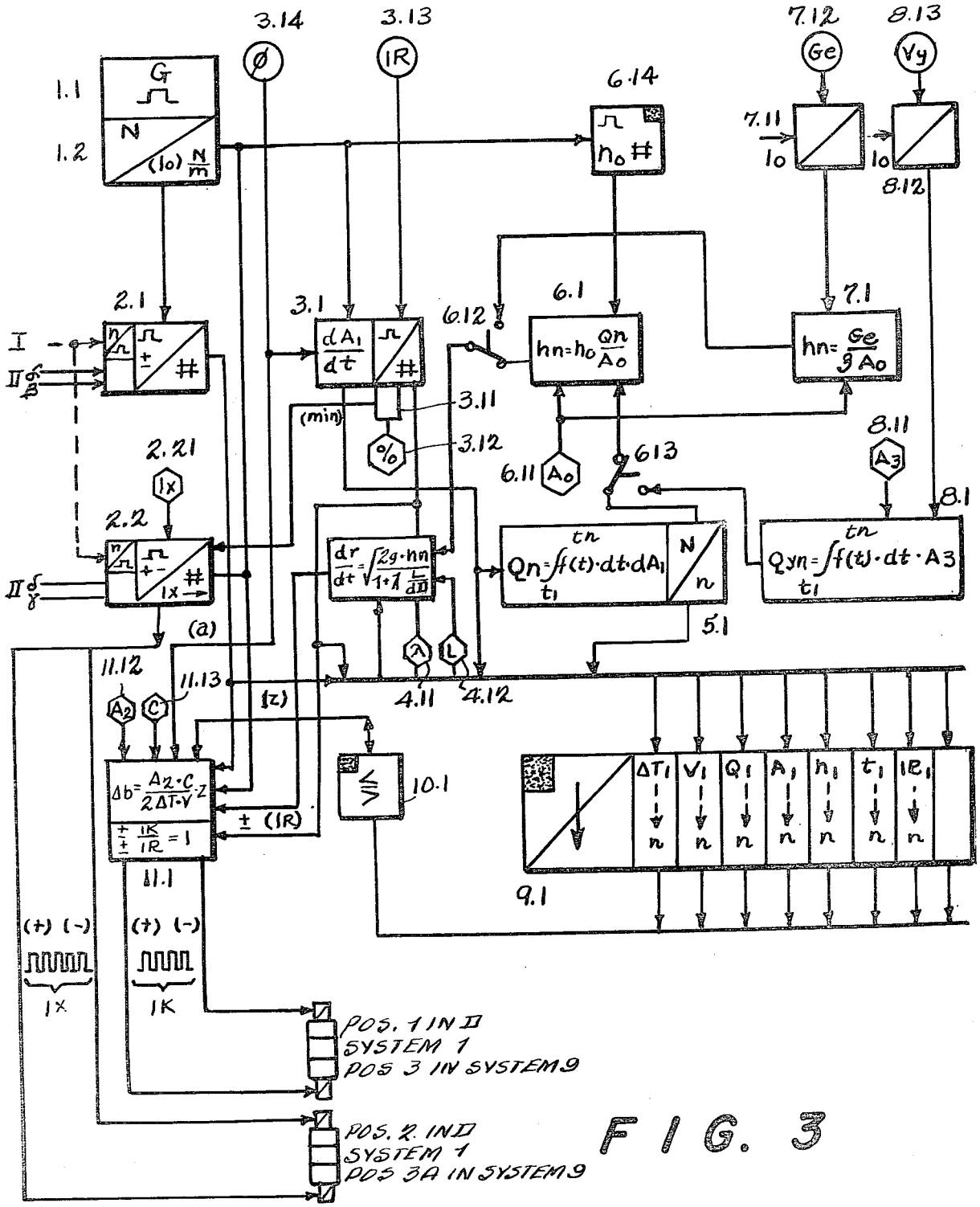
FIG. 3 shows a preferred control unit for carrying out the method according to the invention.

FIG. 3 further includes the parameter Ge indicating the weight of the ladle. Of course, it would also be possible to perform the operation with a weighing device for the tundish or even for the mold.

Also, the above described control unit C (FIG. 3) is particularly useful if a plurality of rates of withdrawal 8.13 are to be detected, e.g. if a plurality of cast strands are fed by a single tundish. In such case, the value or magnitude Qyn in the arithmetic unit 8.1 stands for the sum of all volumes poured or tapped.

In the following, the correction factor Z of equation (7) will be explained. Ideally, the correction factor is $Z=1.0$. This ideal situation exists when the nozzle damper in the control steps performed in response of the process data has reached, or will reach, its optimum open position.

During the discharge process of a ladle mounted above a continuous casting system, in the course of the above described control process, data (units) are stored in a parallel shift register 9.1, namely during every cycle of activity of the control, i.e. when the melt level limit detection positions $\beta$or $\alpha$, respectively, are exceeded both in positive and in negative direction. Hereby, the parallel shift register acts to store in parallel, at every activity time $t_l$ to $t_n$, the values $\Delta T$, v, Q, $A_1$, h and IR. On the basis of the thus stored values, an arithmetic unit 10.1 determines a correction factor which is thereafter fed to arithmetic unit 11.1 for the determination of the magnitude of the next subsequent correction step.

In this way, the next subsequent correction steps each "learn" from the preceding correction steps. Accordingly, the computer 11.1 learns from one step to the next (Teach in).

The described self-learning unit offers particularly the advantage that when the ladle is replaced (sequential casting), the original or initial value of the previous ladle is automatically set for the new ladle, such that the value ho which is not yet controlled prior to the first melt level measurement in the new ladle, corresponds at least to the value learned from the previous ladle. In this way, every new ladle "learns" from the previous ladle; namely ladle 2 resorts to the values of ladle 1, ladle 3 resorts to the values of ladle 2 which already "learned" from ladle 1, etc. The values of ladle 5 then are based upon the experience gained with the respectively preceding ladles which, in turn, learned from each other. Naturally, prior to tapping of the first ladle, the filling level conditions of ladle and tundish must be theoretically entered into the program.

The self-learning effect also has the ruesult that the control of the set value is in each case performed more quickly. Thus Z is a correction factor which is calculated from the experience values of the previous ladles.

Of course, individual corrections may be entered also in the various arithmetic stages. The correction factor varies around the ideal value of 1.0.

The quantity or volume of molten metal flowing through the tapping or casting opening of the ladle at a given instant depends on the ferrostatic head existing in the ladle. According to the invention, in each case the portion of the melt volume that may be supposed to have flown out in the preceding control phase is calculated from memorized values, so as to correspondingly adjust the degree of opening of the damper. The complete control process is monitored by two melt level ldetection positions or at least one such position. A pair of emergency stop detection positions $\delta$ and $\gamma$ each may be added auxiliarly. Thus, damper control is effected in response of a few detection positions only. The entire control unit is accordingly simplified.

It should still be mentioned that in FIG. 3 the pulse quantities Ik and Ix each correspond to a correction stroke or an emergency correction stroke, respectively, which is traversed in a single step. Accordingly, the correction does not take place as a kind of "hunting" of the damper.

As mentioned above, the feedback indication of the exact instantaneous position of the power piston plays an important role with respect to the positioning of the ladle damper or the like.

FIGS. 4 to 6 illustrate preferred devices for detecting the exact position of a power piston. As shown in FIG. 1, the piston-cylinder unit 12 is positioned in the immediate vicinity of the ladle 13, such that it is subjected to extreme ambient conditions, especially to high temperatures.

The piston rod 20 of the power piston 22 associated with the power cylinder 21 is connected to the ladle damper 11 for the positioning thereof.

A measuring cylinder 21 having a volume equivalent to that of the power cylinder 21 is arranged in a position remote from the place of extreme ambient conditions, and it is expedient to reduce the piston and piston rod diameters equally relative to the power cylinder in order thereby to increase correspondingly the length of stroke, this measure providing for improved resolution of the stroke of the measuring piston 24 associated with the measuring cylinder 23.

As the measuring cylinder 23 is not directly subjected to the severe conditions encountered in the steel-making plant or the like, it may be constructed at lesser costs as compared with the power cylinder 21.

As clearly shown in FIG. 4, the working spaces (chambers) 26, 27 of both cylinders 21, 23 through which the respective piston rods 20, 25 pass, are in direct fluid communication with each other through a hydraulic line 28. When the power piston 21 of FIG. 4 moves to the left, the measuring piston 24 moves in a downward direction, and vice versa. Owing to the fluid communication 28, the return liquid in the power cylinder 21 has a direct influence on the position of the measuring piston 24 in the measuring cylinder 23. In this way, exact position feedback of the power piston 22 in power cylinder 21 is ensured. The free end of the piston rod 25 of the measuring piston 24, namely the end extending out from the measuring cylinder 23, has attached thereto a mask 29 which extends into the block of a hybrid coupler 30. The hybrid coupler 30 is connected to an electronic position indicator, and this coupler transmits the position signals indicating the exact position of the power piston 22 to position 3.13 of FIG. 3.

For the correction or compensation of the excess volumes of liquid or liquid losses resulting from leakage in the power cylinder 21, a correction device comprising a pair of pressure limiting valves 31, 32 is provided. One pressure limiting valve 31 is controlled directly by the pump pressure, and is connected to a line 33 leading to the fluid communication (line) 28. This line 33 further includes a correction flowmeter 34 the correction flow signals of which are incorporated as a constant correction value into the indication or recording of the position of the measureing piston 24 and of the power piston 22, respectively. Pressure limiting valve 31 permits to compensate for leakage losses in the working space 26 of power cylinder 21. In the right hand terminal position of the power piston 22 as shown in FIG. 4, pressure limiting valve 31 replenishes such a quantity of pressurized oil that the piston positively assumes a position synchronized with the measuring piston 24.

The other pressure limiting valve 32 is positioned in a branch line 36 extending from the fluid communication 28 to the reservoir 35 for the hydraulic medium. This pressure limiting valve acts to discharge excess volumes of liquid from the working space 26 of power cylinder 21. Such excess volumes of liquid result from leakage between the power piston 22 and the inner wall of power cylinder 21. The working spaces 37, 38 of both cylinders 21, 23 at the sides opposite from the piston rods are adapted to be connected to pump P or to tank T through a 4/3-way valve 39.

As explained above, the pressure limiting valve 31 is controlled directly by the pump pressure, i.e. this valve is directly connected to pump P through line 33. Valve 31 is set so as to open when the measuring piston 24 of FIG. 4 arrives in its upper terminal position. Provided that the power piston 22 has not yet reached its terminal position as shown in FIG. 1, this piston is urged into such position by the hydraulic medium replenished via valve 31. Then, both pistons 22, 24 are synchronized again. In a corresponding manner, the limiting valve 32 compensates for leakage in the opposite direction. Accordingly, said two pressure limiting valves 31 and 32 provide for complete compensation for excess liquid volumes or loss volumes in the terminal positions of pistons 22 and 24, respectively.

The correction flowmeter 34 produces signals only when a correction flow occurs in line 33.

A frequently occuring correction flow or the repeated operation of valves 31, 32 are indication that the power cylinder 21 requires maintenance, for example, replacement of the piston seals or gaskets.

An electronic counter is arranged between the hybrid coupler 30 and input 3.13 for the fedback information of the ladle damper 11 (FIG. 3), in which counter the output signals of the hybrid coupler 30 are processed. When mask 29 travels along a reference path 40, periodic signals are produced. These periodic signals are processed in the counter in such a manner that a forward counting pulse or a backward counting pulse is each generated when a signal of the hybrid coupler 30 is transmitted. By counting these pulses—namely, with the correct sign and from a reference point which may be fixed as desired—, the respective displacement distance is determined which is equivalent to a given pulse quantity IR.

The counted pulses IR are then fed to the central control unit C of FIG. 3 as position references for the piston rod 20 of power piston 22 or the ladle damper connected thereto, respectively, in order to be evaluated in this unit so as to approach a given reference value, as described above.

The device according to FIG. 4 offers the special advantage that sensitive signal generators in the area of extreme ambient conditions are not required. Regardless of leakage in the power cylinder 21, the position of the power piston 22 or of the ladle damper 11 can be detected with accuracy.

FIG. 5 shows another embodiment of a device for detecting the exact position of the power piston of power cylinder 12. In a central hydraulic station, a turbine flowmeter 43, 44 each is mounted upstream of the output 41, 42 of the two hydraulic lines extending to the power cylinder, not shown in FIG. 2. These flowmeters apply, through pulse amplifier units 45, 46, a timing frequency being analogous to the flow quantity to a linkage input circuit of a microprocessor 47. Besides, inputs $E_A$ are linked to the command signals $E_B$ for the direction of operation of the power cylinder as furnished by the microprocessor 47.

The linked signals are directly evaluated or analyzed in a functional arithmetic unit and communicated to the central control unit as feedback or back indication in the form of a pulse quantity IR (position 3.13 in FIG. 3).

This operation is continuous and is not performed in timing or command sequences. Liquid leakage losses are taken into account and processed in the functional arithmetic unit.

FIG. 6 shows another preferred embodiment of a device for the feedback or back indication of the exact position of the power piston. Reference numeral 48 designates the power cylinder of the piston-cylinder unit 12 the piston 49 of which is connected to a control element, e.g. the ladle damper, through a piston rod 50. Pressurized medium may be supplied to one side of piston 49 through a hydraulic line 51, and the piston is adapted to be moved to the right against the action of a gas spring 54 in a bag-type accumulator 53, through the fluid-filled volume 52 and 57. Return movement of the piston 49 to its original position, i.e. to the left hand position of FIG. 6, is effected by expansion of the previously compressed gas contained in the gas cushion 54 or accumulator 53, when the working space, filled with pressurized medium, of the cylinder 48 is connected to a tank. Gas cushion 54 forms an elastic element acting in opposition to the piston pressure when the power or pressurized medium is supplied thereto.

The gas cushion may be replaced by a spring positioned in cylinder 48. Likewise, it is possible to replace the bag-type accumulator 53 by a bellows-type accumulator.

The reaction pressure which the elastic element, i.e. the gas cushion of FIG. 6, exerts upon the piston 49, is detected by means of a pressure meter 55 being operative to detect the pressure of the power or pressure medium in any position of piston 49 within the cylinder. The detected pressure is equal to the reaction pressure of the elastic element and, with given elasticity or spring characteristics, to a specific position of the piston 49 within cylinder 48. The detected pressure values are utilized for the automatic control for the approach to a given piston position. The evaluation of the detected pressure values as well as the utilization of these values for the approach to a set value are performed in control unit C of FIG. 3. As shown in FIG. 6, in addition to automatic control, manual control is possible, too. Manual control is effected by operating a switch 56 by which the automatic set value control system may be disconnected.

The output signals from the pressure evaluation and from the control units C including functional computers are used to control a hydraulic regulator unit 57 which communicates with a hydraulic pump 58 and a tank 59 on the one hand, and with the pressurized medium space 60 of power cylinder 48 on the other hand.

The advantage offered by the above described "reaction force device" are evident. Only a single hydraulic line 51 to the power cylinder 48 is necessary. In the case of a defect in this line, the elastic elements immediately displace the power piston 49 to the left, with the left terminal position of piston 49 preferably coinciding with the closed position of the ladle damper connected to the piston 49 or to the piston rod 50, respectively. Any local signal generators are not required in this apparatus, either.

The device according to FIG. 6 may be combined with the device shown in FIG. 3.

The above described devices for the feedback of the position of the power piston being operatively connected to the ladle damper, are extremely accurate in operation. In this way, a highly stabilized response of the set value control system on the whole is obtained.

The entirety of the features disclosed herein, individually or in combination, are claimed as being essential to the invention, as far as these features are not anticipated by the prior art.

What we claim is:

1. A method of controlling the nozzle damper of a vessel for metallurgical casting in response to a level variation in the volume of molten metal tapped from said vessel comprising the steps of:

(a) monitoring the actual damper opening area from an initial time;

(b) determining the volume of the molten metal discharged from said vessel from said initial time by integrating the previous actual opening areas monitored by said step (a);

(c) determining the vertical level of molten metal above said nozzle damper in response to said step (b); and (d) stepwise adjusting the position of said nozzle damper in response to said step (c).

2. The method of claim 1 further comprising the steps of monitoring the level of the molten metal tapped from said vessel and executing said steps (b)-(d) each time a correction of the opening area occurs in order to obtain a teach-in effect within each casting phase.

3. The method of claim 1, further comprising the steps of monitoring the level of the molten metal tapped from said vessel and executing said steps (b)-(d) each time a limit detection position of said tapped metal is exceeded.

4. The method of claim 3, wherein said executing step further comprises the step of executing said steps (b)-(d) each time said tapped metal level exceeds a set value band in a positive or in a negative direction.

5. The method of claim 1, 3, or 4, further comprising the step adjusting said nozzle damper position at increased speed into a fully closed or fully open position, respectively when said tapped metal level rises above or falls below an uppermost limit or a lowermost limit, respectively.

6. The method of claim 4 wherein said step (d) includes the step of adjusting said nozzle damper position in relation to $$C/(\Delta T \cdot v)$$

wherein

C=span of the set value band;

ΔT=time which lapses during the rise or fall of said tapped metal level across the set value band; and v=the respective rate of tapping.

7. The method of claim 6, wherein said rate of tapping is determined in a computer in accordance with the following equation:

$$v = \sqrt{\frac{2g \cdot hn}{1 + \lambda \cdot \frac{L}{D}}},$$

wherein

L=length of the outlet or nozzle passage;

D=diameter of the outlet or nozzle passage;

λ=resistance coeffecient (flow resistance);

g=gravitation;

hn=actual ferrostatic head within the vessel;

and the ferrostatic head hn is derived from the following equation:

$$hn = ho - Qn/Ao$$

wherein ho=maximum ferrostatic head in the vessel;

Ao=cross-sectional area of the vessel; and

Qn=volume of molten metal discharged from the vessel in the time interval ΔT.

8. The method of claim 3, 4, 6, 7 or 1, wherein said step (b) further comprises the step of calculating said discharged volume, Qn, by the following equation:

$$Qn = \int_{t_1}^{tn} f(t) \cdot dt \cdot A_1$$

wherein $A_1$=actual cross-sectional opening area of the damper.

9. The method of claim 6 or 7 wherein said step (d) further comprises the step of calculating said position adjustment, Δon, on the basis of the following equation:

$$\Delta bn = f\left(\frac{C}{\Delta T \cdot v} \cdot Z\right)$$

wherein "Z" is a correction factor which is calculated from a comparison of at least part of the actual nozzle damper positions with the respective actual nozzle damper positions of the preceding said step (d).

10. The method according to claim 9, further comprising the steps of storing the actual values ΔT=time interval v=rate of tapping Q=volume of molten metal $A_1$=actual cross-sectional opening of said nozzle damper H=ferrostatic head within the vessel in parallel fashion in a parallel shift register; comparing said stored actual values with the corresponding, subsequent actual values, and thereafter shifting said stored actual values into an arithmetic unit for calculation of the correction factor.

11. The method according to claim 3, 4, 6, 7 or 1 wherein said step (d) includes the step of controlling said nozzle damper by a hydraulic power piston-cylinder unit and said step (a) includes the step of employing a reference piston-cylinder unit arranged in a position remote from the extreme ambient conditions of said vessel, wherein liquid leakage losses occurring in the power cylinder are taken into account.

12. The method of claim 3, 4, 6, 7 or 1 wherein said step (d) includes the step of controlling said nozzle damper by a double-acting piston-cylinder unit, and said step (a) includes the step of measuring said actual damper opening with flowmeters associated with both working chambers of said cylinder, wherein liquid leakage losses occurring in said cylinder are taken into account.

13. The method of claim 3, 4, 6, 7 or 1 wherein said step (d) includes the step of controlling said nozzle damper by a piston-cylinder unit, and said step (a) includes the step of detecting the pressure acting in opposition to the piston pressure of an elastic element which acts upon said piston.

* * * * *